United States Patent [19]

Sandbank

[11] 4,168,005

[45] Sep. 18, 1979

[54] APPARATUS FOR SEPARATING OBJECTS OF A PARTICULAR KIND FROM A STREAM OF FALLING OBJECTS

[75] Inventor: Hans A. Sandbank, London, England

[73] Assignee: Andrex N.D.T. Products (UK) Limited, Wembley, England

[21] Appl. No.: 829,620

[22] Filed: Sep. 1, 1977

[30] Foreign Application Priority Data

Sep. 22, 1976 [GB] United Kingdom ..... 39336/76

[51] Int. Cl.[2] ..... B07C 5/00

[52] U.S. Cl. ..... 209/552; 209/638; 209/657

[58] Field of Search ..... 209/74, 74 M, 111.5, 209/111.6, 111.7 R, 111.7 T

[56] References Cited

U.S. PATENT DOCUMENTS

| | | | |
|---|---|---|---|
| 3,137,392 | 6/1964 | Slight | 209/111.5 |
| 3,675,769 | 7/1972 | Story | 209/111.5 |
| 3,768,644 | 10/1973 | DiFrank | 209/74 R |

FOREIGN PATENT DOCUMENTS

| | | | |
|---|---|---|---|
| 1346566 | 2/1974 | United Kingdom | 209/111.5 |

*Primary Examiner*—Allen N. Knowles

*Attorney, Agent, or Firm*—Kirschstein, Kirschstein, Ottinger & Cobrin

[57] ABSTRACT

A separating apparatus for separating objects of a particular kind from a stream of falling objects e.g. for use in crop harvesting comprising a movable separating member which is alternately held stationary in a first position to deflect objects of the particular kind in one direction and moved to a second position to allow other objects to fall in another direction wherein the separating member is moved between its first and second positions in such a manner, e.g. with an essentially reciprocating motion, that the volume swept by the separating member in the path of the falling objects is comparable with the volume of the separating member itself so that objects can follow one another at a close spacing without preventing satisfactory separating action.

4 Claims, 3 Drawing Figures

APPARATUS FOR SEPARATING OBJECTS OF A PARTICULAR KIND FROM A STREAM OF FALLING OBJECTS

This invention relates to apparatus for separating objects of a particular kind from a stream of falling objects.

The invention relates particularly to such apparatus of the kind comprising sensing means for detecting the presence of objects of said particular kind in a stream of falling objects; a separating mechanism including at least one movable separating member which is positioned downstream of the sensing means along the path of the falling objects; and control means arranged to control said separating mechanism in response to the output of the sensing means so that the separating member is alternately held stationary in a first position in the path of the falling objects and moved to a second position clear of the path of the falling objects, so that objects of said particular kind are deflected in a first direction by the separating member when stationary in said first position and other objects are free to fall in another direction when the separating member is moved to said second position, or vice versa.

Such an apparatus, hereinafter referred to as an apparatus of the kind specified, finds particular application in separating stones, clods of earth and other unwanted materials from crops during harvesting. It is a feature of apparatus of the kind specified that deflected objects strike the separating member when it is stationary, thus minimising damage to deflected objects. One example of such an apparatus is disclosed in the specification of U.S. Pat. No. 3,137,392 issued on June 16, 1964 to David L. Slight.

One difficulty which arises with apparatus of the kind specified of known from will now be explained with reference to the accompanying drawings in which.

Figure 1:
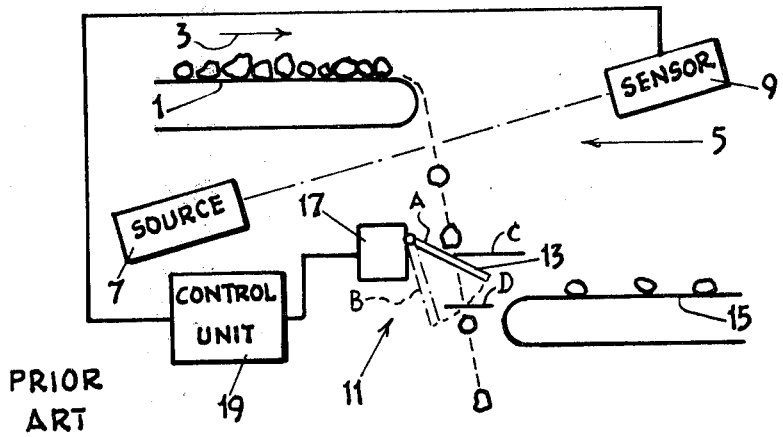
FIG. 1 is a diagrammatic side view of one apparatus of the kind specified of known form.

Referring to FIG. 1, in the known apparatus the objects are fed to the separating apparatus on a conveyor 1 travelling in the direction of the arrow 3, the objects having previously been spread out on the conveyor 1 so as to lie side by side on the conveyor 1. On reaching the end of the conveyor 1 the objects fall under gravity through a sensing device 5 and subsequently through a separating mechanism 7.

Where the apparatus is intended for use in separating stones, clods of earth and other unwanted objects from potatoes during harvesting, the sensing device 5 typically comprises a source 7 which directs a beam of X-rays onto a sensor 9. The falling objects interrupt the X-ray beam, and due to the fact that X-rays are attenuated less by potatoes than by the unwanted objects, the output of the sensor 9 indicates when an unwanted object is interrupting the X-ray beam.

The separating mechanism 11 includes a pivoted finger 13 which is normally held in position A so as to deflect the falling objects onto a second conveyor 15 travelling in the same direction as the conveyor 1. In response to the detection of an unwanted object by the sensing device 5 the finger 13 is temporarily moved downwardly to position B by a prime mover 17 under the control of a unit 19 so as to allow the detected unwanted object to fall onto the ground instead of being deflected onto the conveyor 15.

It will be appreciated that with such an arrangement the finger 13 must be moved from position A before the lower edge of an unwanted object reaches the line C and must not be moved back from position B towards position A until the upper edge of the object has reached line D. Thus a wanted object following an unwanted object may have passed line C before the finger returns to position A, and will therefore be struck by the finger while moving, unless the minimum possible spacing between successive falling objects is large enough to avoid this. This in turn imposes an upper limit on the rate of throughput of objects.

It is an object of the present invention to provide an apparatus of the kind specified wherein this difficulty is alleviated.

According to the present invention in an apparatus of the kind specified movement of the separating member between its first and second positions is such that the dimension of the volume swept during such movement by the separating member in the path of the falling objects in the direction in which the objects fall is not significantly greater than the corresponding dimension of the volume in said path occupied by said member when in said first position.

In a preferred arrangement in accordance with the invention said separating member comprises a bent end portion of a member arranged for rotational movement about an axis removed from said bent portion, the bent portion lying generally in a plane parallel to said axis.

Where the apparatus includes a plurality of separating members disposed side-by-side in a bank, said separating members are preferably arranged for rotation about a common axis extending in a direction substantially parallel to the length of the bank.

One separating apparatus in accordance with the invention will now be described by way of example with reference to FIGS. 2 and 3 of the accompanying drawings.

The apparatus is intended for use in separating stones, clods of earth and other unwanted objects from potatoes during harvesting.

Figure 2:
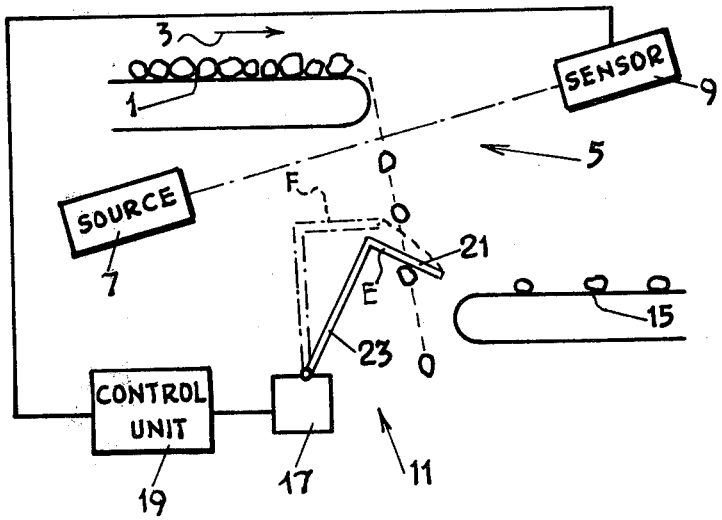
FIG. 2 is a diagrammatic side view of one apparatus of the kind specified in accordance with the present invention.
Figure 3:
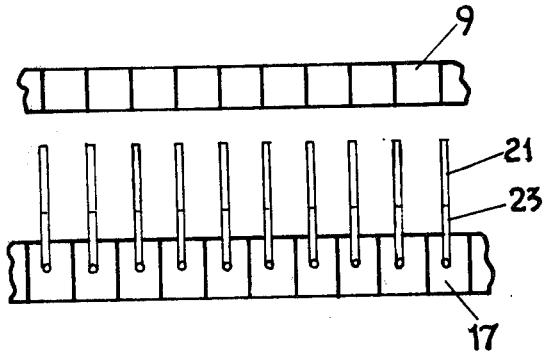
FIG. 3 is a diagrammatic plan view of part of one apparatus of the kind specified in accordance with the present invention.

Referring to FIG. 2 the apparatus is essentially identical with that shown in FIG. 1 except for the form of the separating mechanism 11. Thus, corresponding parts of FIGS. 1 and 2 are given the same reference numerals.

In FIG. 2 the separating member comprises an end portion 21 of a rod 23, the portion 21 extending at right angles to the remainder of the rod 23. The rod 23 is arranged for rotational movement about axis extending through the rod 23 at a point removed from the portion 21, in a direction such that the portion 21 moves essentially in the direction of its length. Movement of the rod 21 is effected by the prime mover 17 under the control of the unit 19.

In operation, the rod 23 is normally held so that portion 21 occupies a position E so as to deflect the falling objects onto the conveyor 15. In response to detection of an unwanted object by the sensing device the rod 23 is rotated so that the portion 21 moves temporarily to a position F clear of the path of the falling objects, thus allowing the detected unwanted object to fall onto the ground instead of being deflected onto the conveyor 15.

It will be seen that since the volume swept by portion 21 has a dimension along the path of the falling objects which is small compared with the corresponding dimension of the volume swept by finger 13 in the arrangement of FIG. 1, objects may follow one another at a closer spacing than in the arrangement of FIG. 1. Thus the rate of throughput of objects with the arrangement of FIG. 2 may be greater than with the arrangement of FIG. 1.

It will be appreciated that in the drawing a single sensing device 5 and separating mechanism 11 only are shown, for simplicity. In a practical arrangement a number of separating mechanisms are provided whose separating members are disposed in spaced relation across the width of the conveyor 1, and a number of sensing devices are provided whose sensors are similarly spaced across the width of the conveyor 1. The X-ray beams for the sensors are typically derived from a common source and each sensor may be arranged to control one or more separating members. In a typical arrangement the sensors 9 are positioned so as to appear to lie between the separating members 21 when viewed vertically, as shown in FIG. 3, and each sensor controls the separating members on either side of it, the members being arranged for pivotal movement about a common axis parallel to the length of the bank.

In the simplest possible arrangement the separating mechanism 11 is controlled by the sensing device 5 so that the portion 21 of the rod moves from position E to position F on a predetermined time after detection of an unwanted object and remains in position F for a predetermined time. However, if desired, in order to improve operation with objects of differing sizes, movement of the separating member may be controlled in dependence on a physical dimension of the object detected by the sensing means. Such arrangements form the subject of my U.S. patent application No. 769,053 filed 16th Feb. 1977.

It will be understood that in an arrangement in accordance with the invention the separating member is not necessarily a portion of a member subject to rotational movement. Thus, in an alternative arrangement, the separating member may be, or constitute part of, a member subject to reciprocating motion in an appropriate direction.

I claim:

1. An apparatus for separating objects of a particular kind from a stream of falling objects comprising sensing means for detecting the presence of objects of said particular kind in a stream of falling objects; a separating mechanism including at least one movable separating member which is positioned downstream of the sensing means along the path of the falling objects; and control means arranged to control said separating mechanism in response to the output of the sensing means so that the separating member is alternately held stationary in a first position in the path of the falling objects and moved to a second position clear of the path of the falling objects, so that objects of said particular kind are deflected in a first direction by the separating member when stationary in said first position and other objects are free to fall in another direction when the separating member is moved to said second position, or vice versa; and including the improvement that the part of the volume swept by said separating member, as it moves between its first and second positions, that is in the path of the falling objects has a maximum dimension in the direction in which the objects fall that is smaller than its maximum dimension in the direction of movement of said separating member.

2. An apparatus according to claim 1 wherein said separating member comprises a bent end portion of a member arranged for rotational movement about an axis removed from said bent portion, the bent portion lying generally in a plane parallel to said axis.

3. An apparatus according to claim 2 wherein said end portion extends at right angles to the remainder of said member in a direction normal to said axis.

4. An apparatus according to claim 3 including a plurality of separating members disposed side-by-side in a bank, said separating members being arranged for rotation about a common axis extending in a direction substantially parallel to the length of the bank.

* * * * *